US010511079B2

(12) United States Patent
Wu et al.

(10) Patent No.: US 10,511,079 B2
(45) Date of Patent: Dec. 17, 2019

(54) ELECTRONIC DEVICE AND ANTENNA STRUCTURE THEREOF

(71) Applicant: PEGATRON CORPORATION, Taipei (TW)

(72) Inventors: Chien-Yi Wu, Taipei (TW); Ya-Jyun Li, Taipei (TW); Yu-Yi Chu, Taipei (TW); Chao-Hsu Wu, Taipei (TW); Ching-Hsiang Ko, Taipei (TW); Chia-Chi Chang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 138 days.

(21) Appl. No.: 15/895,870

(22) Filed: Feb. 13, 2018

(65) Prior Publication Data

US 2018/0331415 A1 Nov. 15, 2018

Related U.S. Application Data

(60) Provisional application No. 62/503,676, filed on May 9, 2017.

(30) Foreign Application Priority Data

Jul. 3, 2017 (TW) ..... 106122207 A

(51) Int. Cl.
*H01Q 1/22* (2006.01)
*H01Q 1/42* (2006.01)
(Continued)

(52) U.S. Cl.
CPC ..... *H01Q 1/2258* (2013.01); *H01Q 1/2266* (2013.01); *H01Q 1/243* (2013.01);
(Continued)

(58) Field of Classification Search
CPC ..... H01Q 1/2258; H01Q 1/2266; H01Q 1/48; H01Q 1/38; H01Q 1/243; H01Q 9/42; H01Q 13/085; H01Q 5/364; H01Q 1/42
(Continued)

(56) References Cited

U.S. PATENT DOCUMENTS 8,294,620 B2 * 10/2012 Flint ..... H01Q 1/2266 343/702
9,209,512 B2 12/2015 Cheng et al.
(Continued)

FOREIGN PATENT DOCUMENTS

| | | |
|---|---|---|
| CN | 104183903 | 12/2014 |
| TW | 201703350 | 1/2017 |
| TW | 201705610 | 2/2017 |

OTHER PUBLICATIONS

"Office Action of Taiwan Counterpart Application," dated Aug. 6, 2018, pp. 1-6.

*Primary Examiner* — Khai M Nguyen
(74) *Attorney, Agent, or Firm* — J. C. Patents

(57) ABSTRACT

An antenna structure including a conductive housing, a substrate, a ground element and a radiation element is provided. The conductive housing includes an open slot and a conductive segment adjacent to each other. The radiation element is disposed on a first surface of the substrate and is electrically connected to the ground element. A second surface of the substrate faces the open slot and the conductive segment. The ground element is electrically connected to the conductive housing. The radiation element has a feeding point and forms a first path. An orthogonal projection of the radiation element on the conductive housing is partially overlapping with the conductive segment such that the conductive housing and the radiation element form a
(Continued)

second path. The antenna structure operates in a first band and a second band through the first path and the second path.

20 Claims, 7 Drawing Sheets

(51) Int. Cl.

| | |
|---|---|
| ***H01Q 13/08*** | (2006.01) |
| ***H01Q 5/364*** | (2015.01) |
| ***H01Q 1/24*** | (2006.01) |
| ***H01Q 1/38*** | (2006.01) |
| ***H01Q 1/48*** | (2006.01) |
| ***H01Q 9/42*** | (2006.01) |

(52) U.S. Cl.
CPC ..... *H01Q 1/38* (2013.01); *H01Q 1/42* (2013.01); *H01Q 1/48* (2013.01); *H01Q 5/364* (2015.01); *H01Q 9/42* (2013.01); *H01Q 13/085* (2013.01)

(58) Field of Classification Search
USPC ..... 343/702, 700 MS, 725, 767, 770, 846
See application file for complete search history.

(56) References Cited

U.S. PATENT DOCUMENTS

| | | | | |
|---|---|---|---|---|
| 9,929,473 | B2 * | 3/2018 | Huang ..... | H01Q 13/106 |
| 2017/0005414 | A1 | 1/2017 | Yang | |
| 2017/0033467 | A1 | 2/2017 | Huang et al. | |

* cited by examiner

ELECTRONIC DEVICE AND ANTENNA STRUCTURE THEREOF

CROSS-REFERENCE TO RELATED APPLICATION

This application claims the priority benefits of U.S. provisional application Ser. No. 62/503,676, filed on May 9, 2017, and Taiwan application serial no. 106122207, filed on Jul. 3, 2017. The entirety of each of the above-mentioned patent applications is hereby incorporated by reference herein and made a part of this specification.

BACKGROUND OF THE INVENTION

1. Field of the Invention

The invention relates to an electronic device and an antenna structure thereof, and more particularly, to an electronic device that includes a conductive housing having an open slot and an antenna structure thereof.

2. Description of Related Art

In recent years, most of notebook computers adopt an exterior design with a narrow frame and a conductive housing with metallic texture in order to emphasize the uniqueness of the product and attract the attention of consumers. In response to design requirements for the narrow frame, an antenna structure in the notebook computer is usually designed and disposed on a plastic hinge under a display panel. Further, a signal bus of the display panel is also disposed across the plastic hinge, so as to connect electronic elements in two bodies of the notebook computer. However, to reduce the influence on antenna caused by the signal bus, the antenna structure disposed in the plastic hinge needs to be placed far away from the signal bus such that a larger disposition space in the notebook computer will be occupied. In addition, the conductive housing of the notebook computer also affects a radiation characteristic of the antenna structure. Therefore, finding a way to save the disposition space for the antenna structure while improving the radiation characteristic of the antenna structure under the design requirements of the narrow frame and the conductive housing is an important issue to be addressed in antenna design for the notebook computer.

SUMMARY OF THE INVENTION

The invention provides an electronic device and an antenna structure thereof, which are capable of saving the disposition space for the antenna structure while improving the radiation characteristic of the antenna structure.

The antenna structure of the invention includes a conductive housing, a substrate, a ground element and a radiation element. The conductive housing includes an open slot and a conductive segment adjacent to each other. The substrate includes a first surface and a second surface opposite to each other, and the second surface faces the open slot and the conductive segment. The ground element is electrically connected to the conductive housing. The radiation element is disposed on the first surface and is electrically connected to the ground element. The radiation element has a feeding point and forms a first path. An orthogonal projection of the radiation element on the conductive housing is partially overlapping with the conductive segment such that the conductive housing and the radiation element form a second path. The antenna structure operates in a first band and a second band through the first path and the second path.

The electronic device of the invention includes a hinge, a first body, a second body, a substrate, a ground element and a radiation element. A conductive housing of the first body includes an open slot and a conductive segment adjacent to each other. The first body and the second body relatively rotate through the hinge. The substrate includes a first surface and a second surface opposite to each other, and the second surface faces the open slot and the conductive segment. The ground element is electrically connected to the conductive housing. The radiation element is disposed on the first surface and is electrically connected to the ground element. The radiation element has a feeding point and forms a first path. An orthogonal projection of the radiation element on the conductive housing is partially overlapping with the conductive segment such that the conductive housing and the radiation element form a second path. The conductive housing, the substrate, the ground element and the radiation element form an antenna structure. The antenna structure operates in a first band and a second band through the first path and the second path.

Based on the above, the conductive housing, the substrate, the ground element and the radiation element are used to form the antenna structure in the invention. Also, the radiation element can form the first path in the antenna structure, the conductive housing and the radiation element can form the second path in the antenna structure, and the antenna structure can operate in the first band and the second band through the first path and the second path. In this way, the disposition space of the electronic device occupied by the antenna structure can be reduced and the radiation characteristic of the antenna structure can be improved.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
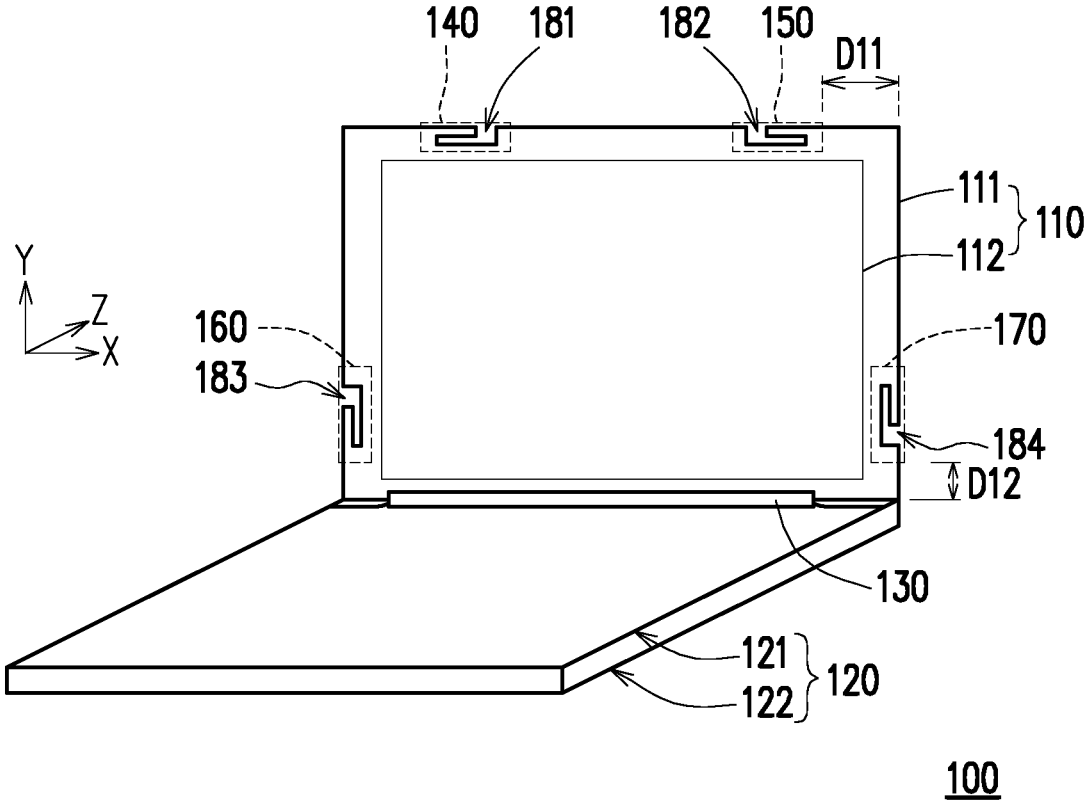
FIG. 1 is a schematic diagram of an electronic device according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic diagram of an electronic device according to an embodiment of the invention. As shown in FIG. 1, an electronic device 100 may be, for example, a notebook computer, and the electronic device 100 includes a first body 110, a second body 120 and a hinge 130. The hinge 130 is disposed between the first body 110 and the second body 120, and the first body 110 and the second body 120 can relatively rotate through the hinge 130. In addition, the first body 110 includes a conductive housing 111 and a display panel 112, and a conductive frame surrounding the display panel 112 is not illustrated in FIG. 1 for clearer description. The second body 120 includes a conductive housing 121 and a conductive housing 122, and the electronic device 100 further includes a keyboard disposed (not shown) on the conductive housing 121.

Further, the electronic device 100 further includes antenna structures 140 and 150 disposed on top of the display panel 112 and antenna structures 160 and 170 respectively disposed on left and right sides of the display panel 112. The conductive housing 111 is part of each of the antenna structures 140 to 170, and disposing positions of the antenna structures 140 to 170 are simply marked by using dotted lines in FIG. 1 for clearer description. In the overall configuration, each of the antenna structures 140 to 170 corresponds to an open slot in the conductive housing 111. For instance, the conductive housing 111 includes open slots 181 to 184, and the open slots 181 to 184 correspond to the antenna structures 140 to 170 one by one.

It should be noted that, each of the antenna structures 140 to 170 can form a first path by using a radiation element, and the radiation element can form a second path together with the conductive housing surrounding the open slot. In this way, the antenna structures 140 to 170 can provide characteristics of multi-band operation, small size, low profile and better selectivity, and the disposing space of the electronic device 100 occupied by the antenna structures 140 to 170 can be reduced. Further, since the conductive housing 111 is part of each of the antenna structures 140 to 170, the influence on the antenna structures 140 to 170 caused by the conductive housing (e.g., the conductive housings 111, 121 and 122) in electronic device 100 can be reduced, and the radiation characteristic of the antenna structures 140 and 170 can be improved. Furthermore, the electronic device 100 may also support multi-input multi-output (MIMO) technology in the fifth generation (5G) mobile communication by using the antenna structures 140 to 170.

Figure 2:
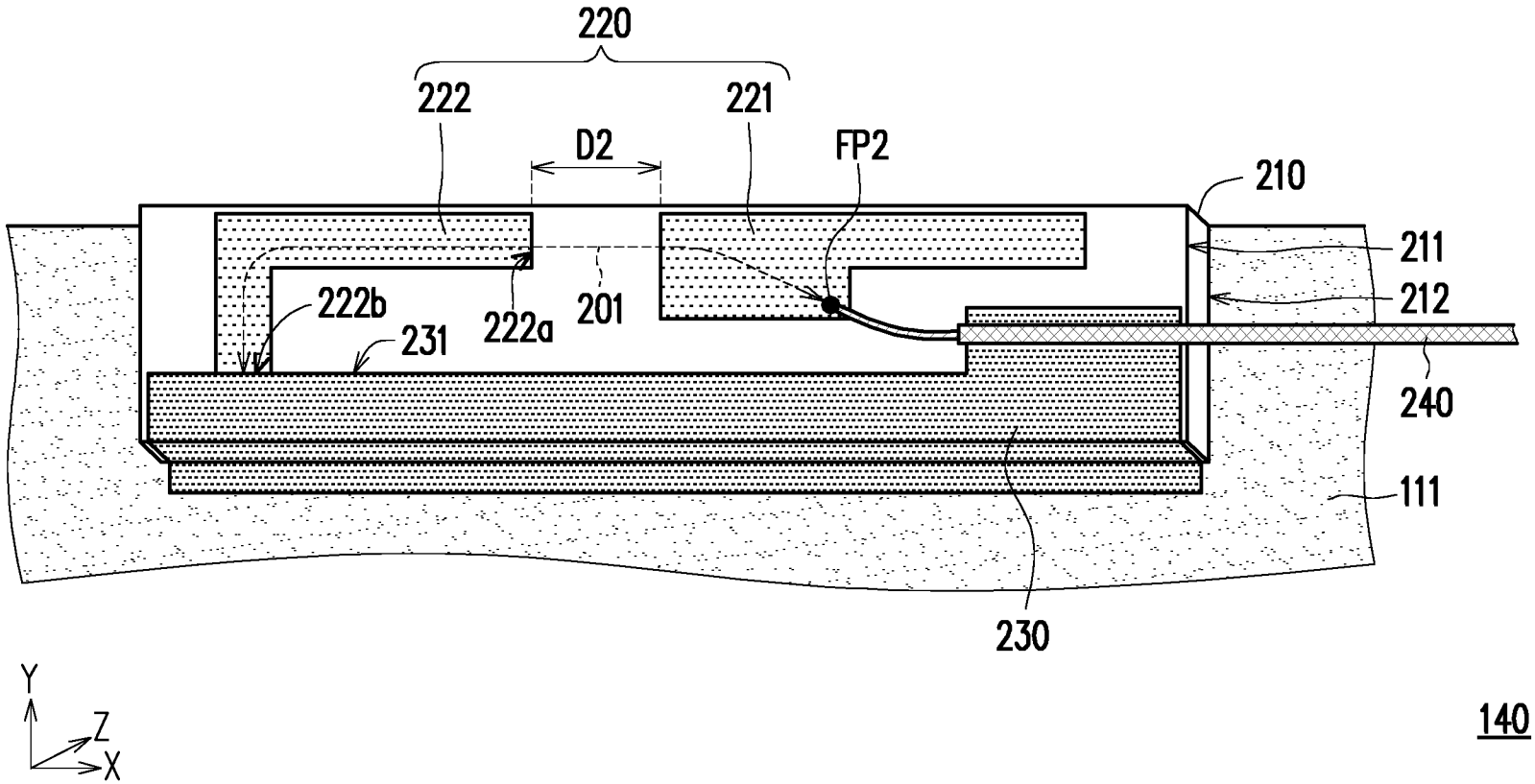
FIG. 2 is a schematic diagram of an antenna structure according to an embodiment of the invention.

To facilitate persons skilled in the art in understanding the invention more clearly, the antenna structure 140 is described in more details with examples below. Specifically, FIG. 2 is a schematic diagram of an antenna structure according to an embodiment of the invention. As shown in FIG. 2, the antenna structure 140 includes part of the conductive housing 111, a substrate 210, a radiation element 220 and a ground element 230. The substrate 210 includes a first surface 211 and a second surface 212 opposite to each other. The radiation element 220 is disposed on the first surface 211 of the substrate 210 and the radiation element 220 is electrically connected to the ground element 230. Part of the ground element 230 is disposed on the first surface 211 of the substrate 210, and the ground element 230 extends to be on top of the conductive housing 111 along −Y-axis direction. Further, the ground element 230 on top of the conductive housing 111 is electrically connected to the conductive housing 111.

In terms of operation, the radiation element 220 has a feeding point FP2. The feeding point FP2 of the radiation element 220 is electrically connected to an inner conductor of a coaxial cable 240, and the ground element 230 is electrically connected to an outer conductor of the coaxial cable 240. In this way, the radiation element 220 can be electrically connected to a transceiver (e.g., the transceiver of a WiFi wireless transceiving module) in the electronic device 100 through the coaxial cable 240 in order to receive a feeding signal from the transceiver. In addition, the radiation element 220 can form a first path 201. Under the excitation of the feeding signal, the antenna structure 140 can generate a first resonant mode through the first path 201 to operate in a first band.

For instance, the radiation element 220 includes a first radiation portion 221 and a second radiation portion 222. The first radiation portion 221 and the second radiation portion 222 are disposed on the first surface 211 of the substrate 210, and the first radiation portion 221 and the second radiation portion 222 are arranged in sequence along an edge 231 of the ground element 230. Further, the first radiation portion 221 has the feeding point FP2, and the first radiation portion 221 is not electrically connected to the second radiation portion 222 and the ground element 230. The second radiation portion 222 has a first end 222*a* and a second end 222*b*, the first end 222*a* of the second radiation portion 222 is spared apart from the first radiation portion 211 by a coupling distance D2, and the second end 222*b* of the second radiation portion 222 is electrically connected to the edge 231 of the ground element 230.

In terms of operation, the first radiation portion 221 can receive the feeding signal from the transceiver through the feeding point FP2. Further, the feeding signal can be coupled to the second radiation portion 222 from the first radiation portion 221 through the coupling distance D2 to form the first path 201. In other words, the first path 201 extends from the feeding point FP2 to the second end 222*b* of the second radiation portion 222 through the first radiation portion 221, the coupling distance D2 and the second radiation portion 222. Moreover, the first radiation portion 221 and the second radiation portion 222 can form a first open loop antenna, and the first open loop antenna can generate the first resonant mode through the first path 201 to operate in the first band. Furthermore, based on design requirements, persons skilled in the art can adjust shapes or/and sizes of the first radiation portion 221 and the second radiation portion 222 as well as a size of the coupling distance D2, so as to adjust a frequency and a bandwidth of the first band.

Figure 3:
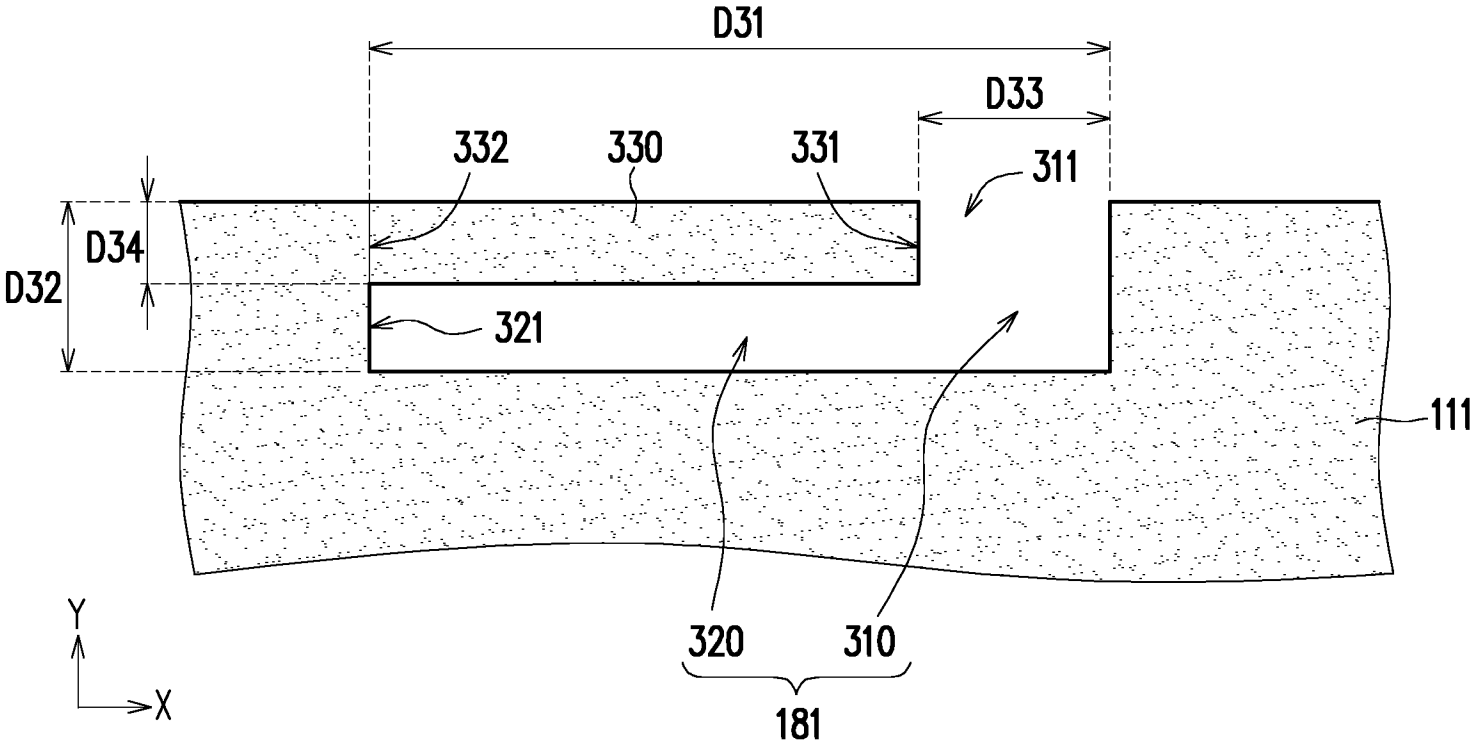
FIG. 3 is a schematic diagram of an open slot according to an embodiment of the invention.

FIG. 3 is a schematic diagram of an open slot according to an embodiment of the invention. As shown in FIG. 3, an open slot 181 corresponding to the antenna structure 140 may be, for example, an inverted L shape. For instance, the open slot 181 includes a first slot 310 and a second slot 320 connected with each other and vertically connected. Further, the first slot 310 is parallel to Y-axis direction and can form an open end 311 of the open slot 181. The second slot 320 is parallel to X-axis direction and can form a closed end 321 of the open slot 181. Part of the conductive housing 111 surrounds the open slot 181 and is used to form part of the antenna structure 140. For example, part of the conductive housing 111 included by the antenna structure 140 includes a conductive segment 330, and the conductive segment 330 is adjacent to the open slot 181. Further, the conductive segment 330 has a first end 331 and a second end 332 opposite to the first end 331. The open end 311 of the open slot 181 is adjacent to the first end 331 of the conductive segment 330, and the closed end 321 of the open slot 181 is adjacent to the second end 332 of the conductive segment 330. Also, in an embodiment, the open slot 181 on the conductive housing 111 may be realized by using an insert modeling (insert molding) technique, and an exterior of the conductive housing 111 may be modified by a spraying technique.

Referring to FIG. 2 and FIG. 3 together, the second surface 212 of the substrate 210 faces the open slot 181 and the conductive segment 330 in the conductive housing 111. That is to say, in FIG. 2, the open slot 181 and the conductive segment 330 are covered by the substrate 210, and the radiation element 220 is opposite to the conductive segment 330 with the substrate 210 in the middle. For instance, FIG. 4 is a schematic projection chart for explaining the antenna structure of FIG. 2, and the substrate 210 is not marked in FIG. 4 for clearer description.

Figure 4:
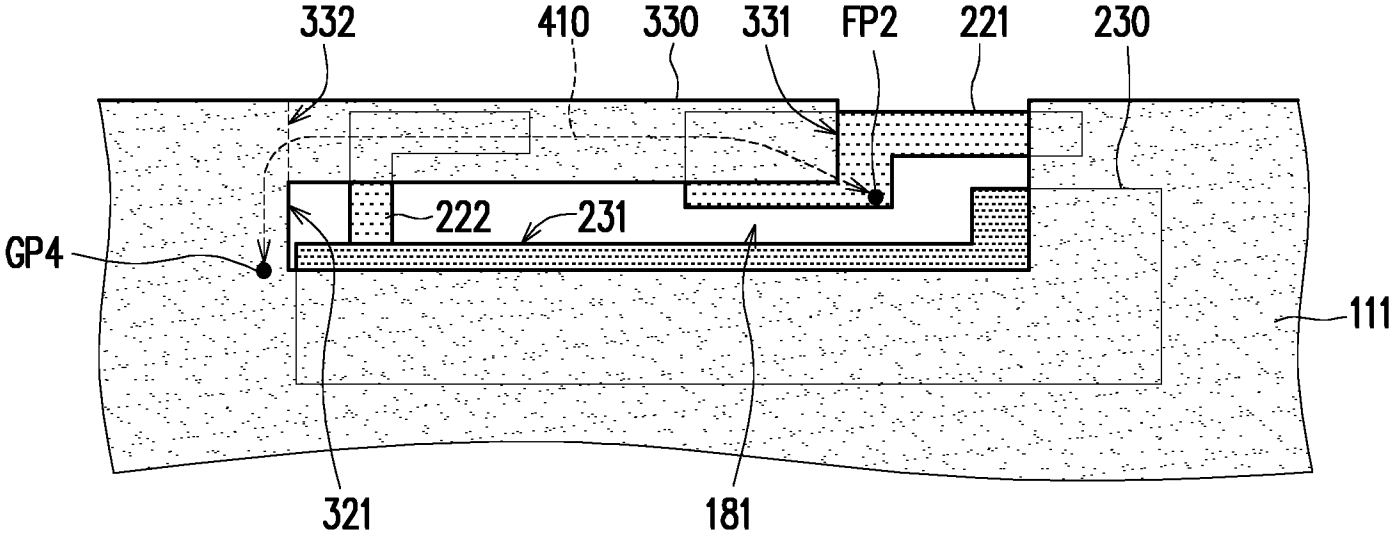
FIG. 4 is a schematic projection chart illustrating the antenna structure of FIG. 2.

As shown in FIG. 4, an orthogonal projection of the first radiation portion 221 on the conductive housing 111 is partially overlapping with the first end 331 of the conductive segment 330. Further, the orthogonal projection of the first radiation portion 221 on the conductive housing 111 covers the open end 311 of the open slot 181. A shape of the second radiation portion 222 may be, for example, an inverted L-shape, and an orthogonal projection of the second end of the second radiation portion 222 on the conductive housing 111 is located within the open slot 181. An orthogonal projection of the edge 231 of the ground element 230 on the conductive housing 111 is parallel to the conductive segment 330.

In terms of operation, since the first radiation portion 221 is disposed on the first surface 211 of the substrate 210 and the second surface 212 of the substrate 210 faces the open slot 181 and the conductive segment 330 of the conductive housing 111, the first radiation portion 221 can be spaced apart from the conductive segment 330 by a coupling distance (such coupling distance is a thickness of the substrate 210). Accordingly, the feeding signal from the first radiation portion 221 can be coupled to the conductive segment 330 to form a second path 410. In other words, the second path 410 extends from the feeding point FP2 to a ground point GP4 in the conductive housing 111 through the first radiation portion 221 and the conductive segment 330. The ground point GP4 is adjacent to the closed end 321 of the open slot 181. Moreover, the first radiation portion 221 and part of the conductive housing 111 can form a second open loop antenna, and the second open loop antenna can generate a second resonant mode through the second path 410 to operate in a second band. Furthermore, based on design requirements, persons skilled in the art can adjust a size of an overlapping area of the first radiation portion 221 and the conductive segment 330 and adjust a shape or/and a size of the conductive segment 330, so as to adjust a frequency and a bandwidth of the second band.

In other words, in the overall configuration, the radiation element 220 can form the planar first open loop antenna. Further, because an orthogonal projection of the radiation element 220 on the conductive housing 111 is partially overlapping with the conductive segment 330, the radiation element 220 and conductive housing 111 can further form the none-planar second open loop antenna. Accordingly, other than operating in the first band through the first path 201 formed by the radiation element 220, the antenna structure 140 can also operate in the second band through the second path 410 formed by the conductive housing 111 and the radiation element 220.

For instance, in an embodiment, a size of the substrate 210 may be 20 mm×4.5 mm×0.4 mm. Further, the thickness of the substrate 210 is preferably to be less than 1 mm so a coupling mechanism between the first radiation portion 221 and the conductive segment 330 can be enhanced. The coupling distance D2 may be 2.5 mm. A length D31 and a width D32 of the open slot 181 may be 17.5 mm and 4 mm respectively, and a length D33 of the open end 311 of the open slot 181 may be 5 mm. Further, a width D34 of the conductive segment 330 may be 1.5 mm. Accordingly, a frequency range of the second band covered by the antenna structure 140 may be 2.4 GHz to 2.5 GHz, and a second harmonic band of the second band may be combined with the first band of the antenna structure 140, such that an operable frequency range of the antenna structure 140 may further include 5.15 GHz to 5.875 GHz.

Figure 5:
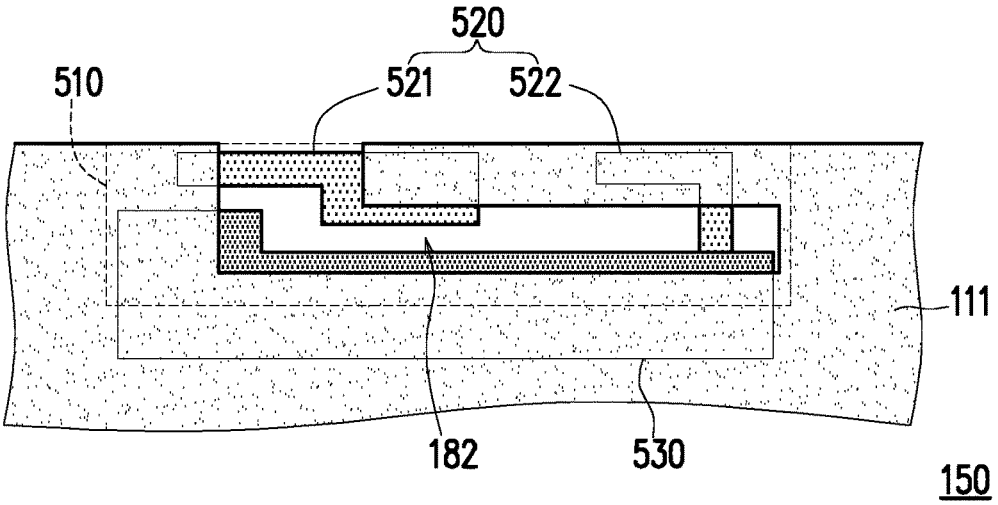
FIG. 5 and FIG. 6 are schematic projection charts illustrating antenna structures according to another embodiment of the invention.
Figure 6:
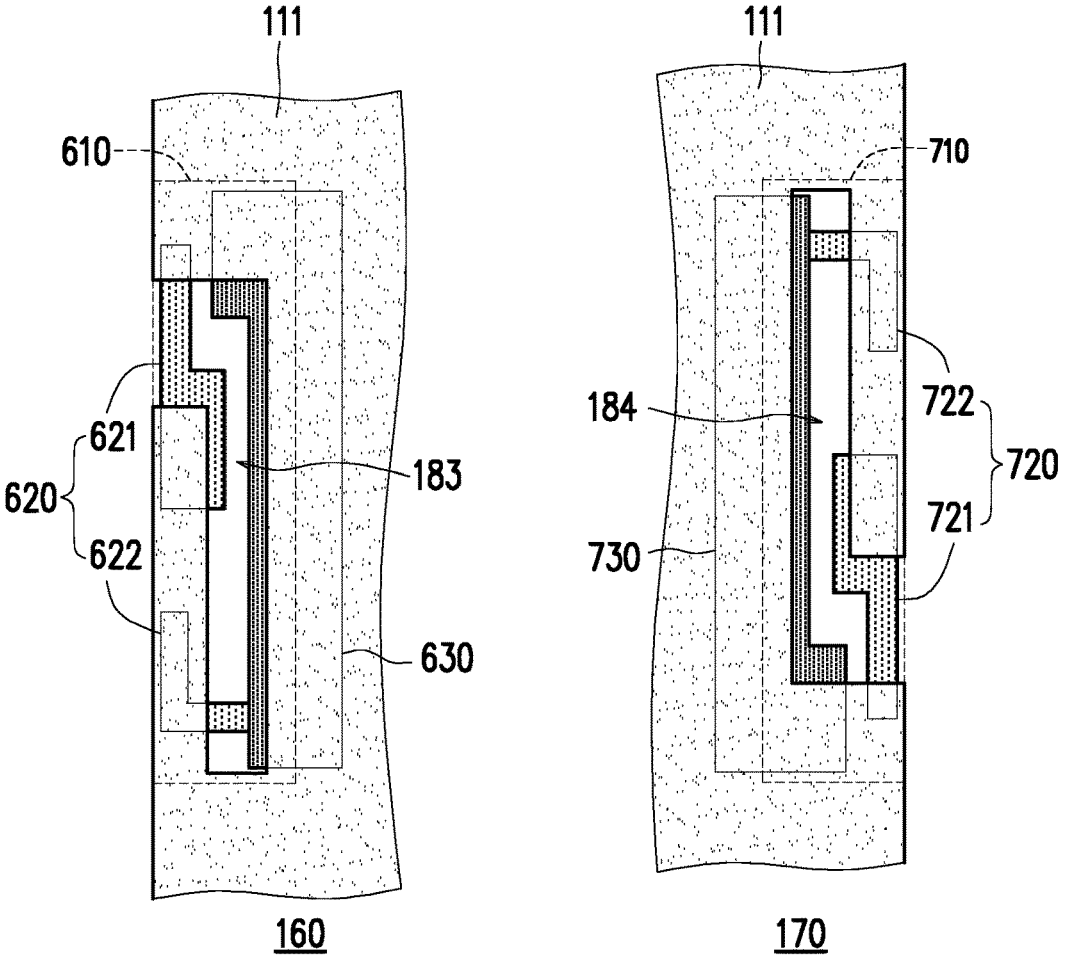

Referring back to FIG. 1, the antenna structures 140 to 170 in the electronic device 100 have the same configuration. For instance, FIG. 5 and FIG. 6 are schematic projection charts illustrating antenna structures according to another embodiment of the invention. As shown in FIG. 5, the antenna structure 150 includes part of the conductive housing 111, a substrate 510, a radiation element 520 and a ground element 530, and the radiation element 520 includes first and second radiation portions 521 and 522. As shown in FIG. 6, the antenna structure 160 includes part of the conductive housing 111, a substrate 610, a radiation element 620 and a ground element 630, and the radiation element 620 includes first and second radiation portions 621 and 622. Moreover, the antenna structure 170 includes part of the conductive housing 111, a substrate 710, a radiation element 720 and a ground element 730, and the radiation element 720 includes first and second radiation portions 721 and 722. Further, detailed structures and operations for each of the elements (e.g., the conductive housing 111, the radiation elements 520 to 720 and the ground elements 530 to 730) in the antenna structures 150 to 170 have been included in the foregoing embodiments of FIGS. 2 to 4, which are not repeated hereinafter.

It is noted that, the antenna structures 140 to 170 may be disposed along a conductive frame surrounding the display panel 112. For instance, with respect to the antenna structures 140 and 150 disposed on top of the display panel 112, the closed ends of the open slots 181 and 182 can point to −X-axis direction or +X-axis direction. With respect to the antenna structures 160 and 170 disposed on the left and right sides of the display panel 112, the closed ends of the open slots 183 and 184 can point to −Y-axis direction or +Y-axis direction. Further, in an embodiment, a distance D11 from each of the antenna structures 140 and 150 to respective edges on the two sides of the conductive housing 111 may be 50 mm, and a distance D12 from each of the antenna structures 160 and 170 to an edge at the bottom may be 15 mm. Although FIG. 1 illustrates a placement of the open slots 181 to 184, the invention is not limited thereto.

Beside, all of the antenna structures 140 and 170 have the characteristics of small size and low profile. For example, sizes of the substrates 210 and 510 of the antenna structures 140 and 150 in Y-axis direction and sizes of the substrates 610 and 710 of the antenna structures 160 and 170 in X-axis direction may all be 4.5 mm so design requirements for the narrow frame for the electronic device 100 can be satisfied. Furthermore, regardless of what the placement of the open slots 181 to 184 is, all of the antenna structures 140 to 170 can also have a favorable radiation characteristic.

Figure 7:
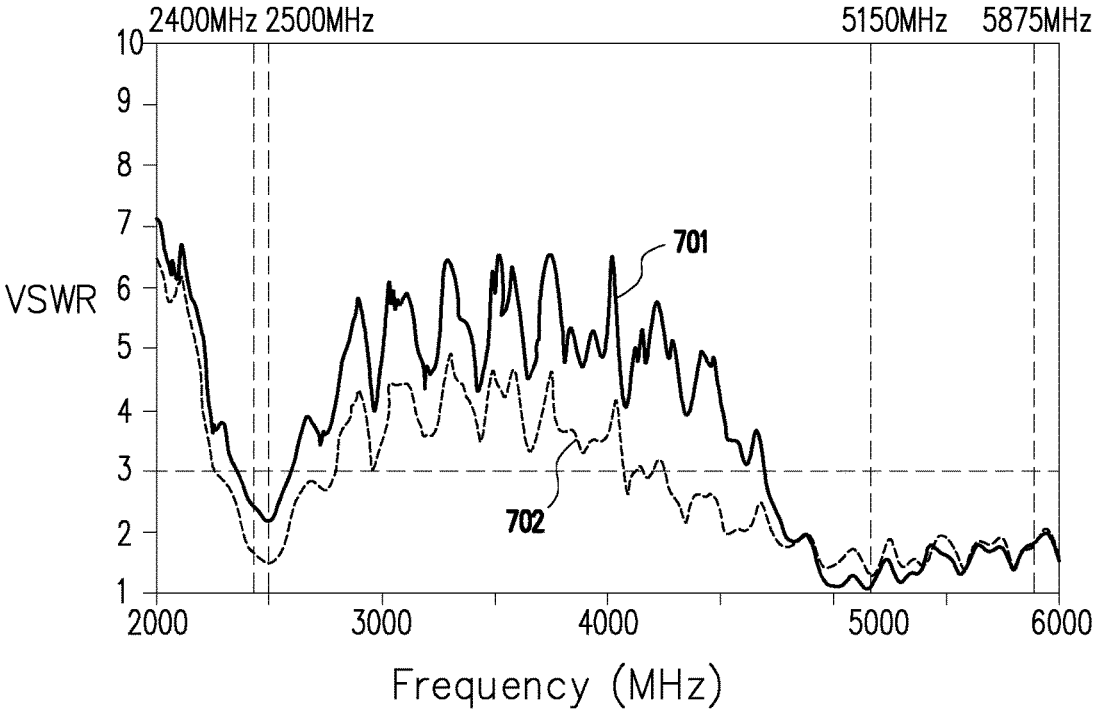
FIG. 7 is a voltage standing wave ratio (VSWR) graph of the antenna structures according to an embodiment of the invention.
Figure 8:
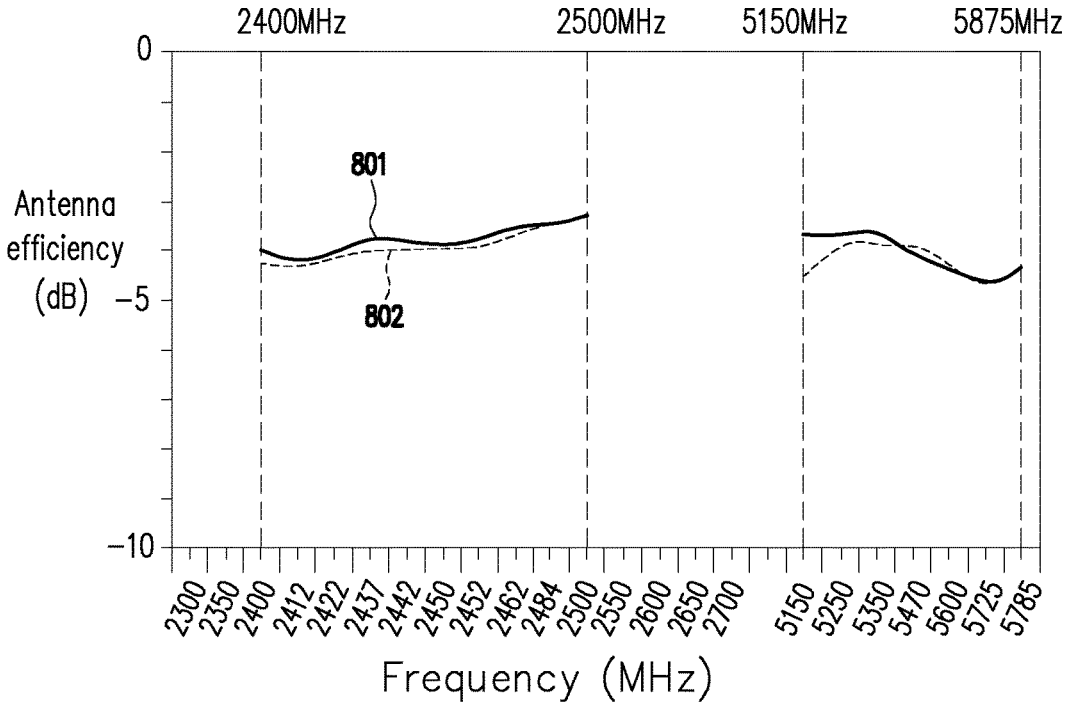
FIG. 8 is an antenna efficiency graph of the antenna structures according to an embodiment of the invention.

For instance, FIG. 7 is a voltage standing wave ratio (VSWR) graph of the antenna structures according to an embodiment of the invention, and FIG. 8 is an antenna efficiency graph of the antenna structures according to an embodiment of the invention. Among them, curves 701 and 702 in FIG. 7 are used to represent voltage standing wave ratios of the antenna structures 160 and 170, and curves 801 and 802 in FIG. 8 are used to represent antenna efficiencies of the antenna structures 160 and 170. In the embodiments of FIG. 7 and FIG. 8, each of the antenna structures 160 and 170 can be electrically connected to a transceiver in the second body 120 through a coaxial cable with a length of 400 mm.

Figure 9:
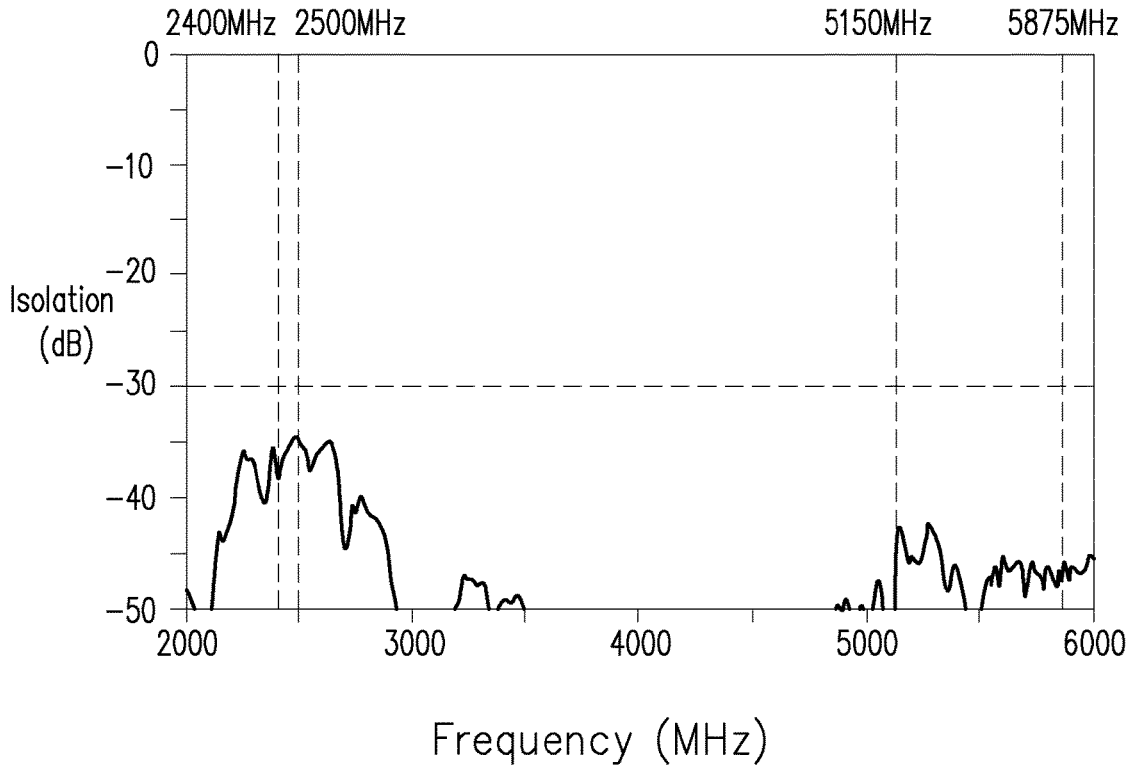
FIG. 9 is an isolation (S21) graph of the antenna structures according to an embodiment of the invention.

As shown in FIG. 7 and FIG. 8, both the antenna structures 160 and 170 can operate in 2.4 GHz band (e.g., 2.4 GHz to 2.5 GHz) and 5 GHz band (e.g., 5.15 GHz to 5.875 GHz). Further, the voltage standing wave ratios of the antenna structures 160 and 170 in 2.4 GHz band and 5 GHz band can all be less than 3. The antenna efficiencies of the antenna structures 160 and 170 in 2.4G band are −3.2 dB to −4.2 dB, and the antenna efficiencies of the antenna structures 160 and 170 in 5G band are −3.6 dB to −4.6 dB. Furthermore, FIG. 9 is an isolation (S21) graph of the antenna structures according to an embodiment of the invention. In the embodiment of FIG. 9, a distance between the antenna structures 160 and 170 is approximately 250 mm, and isolations of the antenna structures 160 and 170 in 2.4 GHz band and 5 GHz band can all be less than −30 dB.

In summary, the antenna structure of the invention includes the radiation element disposed on the first surface of the substrate and the conductive housing facing the second surface of the substrate. Further, the radiation element can form the first path, the conductive housing and the radiation element can form the second path, and the antenna structure can operate in the first band and the second band through the first path and the second path. In this way, the antenna structure can provide the characteristics of multi-band operation, small size, low profile and better selectivity so the disposition space of the electronic device occupied by the antenna structure can be reduced and the radiation characteristic of the antenna structure can be improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An antenna structure, comprising:

a conductive housing, comprising an open slot and a conductive segment adjacent to each other;

a substrate, comprising a first surface and a second surface opposite to each other, the second surface facing the open slot and the conductive segment;

a ground element, electrically connected to the conductive housing; and a radiation element, disposed on the first surface of the substrate, and electrically connected to the ground element, wherein the radiation element has a feeding point and forms a first path, an orthogonal projection of the radiation element on the conductive housing is partially overlapping with the conductive segment such that the conductive housing and the radiation element form a second path, and the antenna structure operates in a first band and a second band through the first path and the second path.

2. The antenna structure according to claim 1, wherein the conductive segment comprises a first end and a second end opposite to the first end, an open end of the open slot is adjacent to the first end of the conductive segment, and a closed end of the open slot is adjacent to the second end of the conductive segment.

3. The antenna structure according to claim 2, wherein the radiation element comprises:

a first radiation portion, disposed on the first surface, the first radiation portion having the feeding point, an orthogonal projection of the first radiation portion on the conductive housing partially overlapping with the first end of the conductive segment; and a second radiation portion, disposed on the first surface, the second radiation portion having a first end and a second end, the first end of the second radiation portion being spaced apart from the first radiation portion by a coupling distance, the second end of the second radiation portion being electrically connected to the ground element.

4. The antenna structure according to claim 3, wherein the first path extends from the feeding point to the second end of the second radiation portion through the first radiation portion, the coupling distance and the second radiation portion.

5. The antenna structure according to claim 3, wherein the conductive housing comprises a ground point adjacent to the closed end of the open slot, and the second path extends from the feeding point to the ground point through the first radiation portion and the conductive segment.

6. The antenna structure according to claim 3, wherein the first radiation portion and the second radiation portion form a first open loop antenna operating in the first band, and the first radiation portion and the conductive housing form a second open loop antenna operating in the second band.

7. The antenna structure according to claim 3, wherein the first radiation portion and the second radiation portion are arranged in sequence along an edge of the ground element, and the second end of the second radiation portion is electrically connected to the edge of the ground element.

8. The antenna structure according to claim 7, wherein the orthogonal projection of the first radiation portion on the conductive housing covers the open end of the open slot, and an orthogonal projection of the second end of the second radiation portion on the conductive housing is located within the open slot.

9. The antenna structure according to claim 7, wherein an orthogonal projection of the edge of the ground element on the conductive housing is parallel to the conductive segment.

10. The antenna structure according to claim 1, wherein the feeding point of the radiation element is electrically connected to an inner conductor of a coaxial cable, and the ground element is electrically connected to an outer conductor of the coaxial cable.

11. An electronic device, comprising:

a hinge;

a first body and a second body, relatively rotating through the hinge, a conductive housing of the first body comprising an open slot and a conductive segment adjacent to each other;

a substrate, comprising a first surface and a second surface opposite to each other, the second surface facing the open slot and the conductive segment;

a ground element, electrically connected to the conductive housing; and a radiation element, disposed on the first surface of the substrate, and electrically connected to the ground element, the radiation element having a feeding point and forming a first path, an orthogonal projection of the radiation element on the conductive housing being partially overlapping with the conductive segment such that the conductive housing and the radiation element form a second path, wherein the conductive housing, the substrate, the ground element and the radiation element form an antenna structure, and the antenna structure operates in a first band and a second band through the first path and the second path.

12. The electronic device according to claim 11, wherein the conductive segment comprises a first end and a second end opposite to the first end, an open end of the open slot is adjacent to the first end of the conductive segment, and a closed end of the open slot is adjacent to the second end of the conductive segment.

13. The electronic device according to claim 12, wherein the radiation element comprises:

a first radiation portion, disposed on the first surface, the first radiation portion having the feeding point, an orthogonal projection of the first radiation portion on the conductive housing partially overlapping with the first end of the conductive segment; and a second radiation portion, disposed on the first surface, the second radiation portion having a first end and a second end, the first end of the second radiation portion being spaced apart from the first radiation portion by a coupling distance, the second end of the second radiation portion being electrically connected to the ground element.

14. The electronic device according to claim 13, wherein the first path extends from the feeding point to the second end of the second radiation portion through the first radiation portion, the coupling distance and the second radiation portion.

15. The electronic device according to claim 13, wherein the conductive housing comprises a ground point adjacent to the closed end of the open slot, and the second path extends from the feeding point to the ground point through the first radiation portion and the conductive segment.

16. The electronic device according to claim 13, wherein the first radiation portion and the second radiation portion form a first open loop antenna operating in the first band, and the first radiation portion and the conductive housing form a second open loop antenna operating in the second band.

17. The electronic device according to claim 13, wherein the first radiation portion and the second radiation portion are arranged in sequence along an edge of the ground element, and the second end of the second radiation portion is electrically connected to the edge of the ground element.

18. The electronic device according to claim 17, wherein the orthogonal projection of the first radiation portion on the conductive housing covers the open end of the open slot, and an orthogonal projection of the second end of the second radiation portion on the conductive housing is located within the open slot.

19. The electronic device according to claim 17, wherein an orthogonal projection of the edge of the ground element on the conductive housing is parallel to the conductive segment.

20. The electronic device according to claim 11, wherein the feeding point of the radiation element is electrically connected to an inner conductor of a coaxial cable, and the ground element is electrically connected to an outer conductor of the coaxial cable.

* * * * *